US005436420A

United States Patent [19]

McFarlin, III et al.

[11] Patent Number: 5,436,420

[45] Date of Patent: Jul. 25, 1995

[54] ELECTRICAL CIRCUIT ASSEMBLY AND METHOD OF OPERATION

[75] Inventors: Gerald T. McFarlin, III, Cary; Daniel C. Crilly, Streamwood; James A. Coffing, Downers Grove, all of Ill.

[73] Assignee: Motorola, Inc., Schaumburg, Ill.

[21] Appl. No.: 168,731

[22] Filed: Dec. 16, 1993

[51] Int. Cl.[6] ..... H01H 35/00; H01H 55/00; H01H 1/00

[52] U.S. Cl. ..... 200/82 R; 335/4

[58] Field of Search ..... 200/5 A, 11 R, 11 DA, 200/16 R, 16 A, 81 R, 81 H, 82 R, 82 B, 150 R; 333/105; 335/18, 157, 4, 5; 337/343

[56] References Cited

U.S. PATENT DOCUMENTS

| | | | |
|---|---|---|---|
| 1,050,592 | 1/1913 | Andersen | 335/157 |
| 3,629,525 | 12/1971 | Glese, Jr. | 200/11 DA |
| 3,792,983 | 7/1981 | Kroll, et al. | 200/16R |
| 4,317,012 | 2/1982 | Itoh | 200/5 A |
| 4,384,183 | 5/1983 | Meshoulam | 200/82 R |
| 4,620,175 | 10/1986 | Karr et al. | 337/343 |
| 4,908,588 | 3/1990 | Hoffman et al. | 333/105 |
| 5,173,673 | 12/1992 | Weigand et al. | 335/18 |
| 5,267,043 | 11/1993 | Rottner et al. | 358/214 |
| 5,296,662 | 3/1994 | Engdahl et al. | 200/150 R |

*Primary Examiner*—J. R. Scott

*Attorney, Agent, or Firm*—James A. Coffing; Daniel C. Crilly

[57] ABSTRACT

An electrical circuit assembly (100) includes an electrically actuatable clamping arrangement (108) that provides a reliable, solderless electrical connection between two electrical circuits (104, 106). The present invention is readily adaptable for use with a first electrical circuit (104) that includes at least one electrical contact area (130) disposed on a substrate (102). The electrically actuatable clamping arrangement (108) is then used to provide an electrical connection between the electrical contact area (130) and a second electrical circuit (106).

13 Claims, 2 Drawing Sheets

ELECTRICAL CIRCUIT ASSEMBLY AND METHOD OF OPERATION

FIELD OF THE INVENTION

The present invention relates generally to electrical circuit assemblies and, in particular, to an electrical circuit assembly that provides a solderless connection between two electrical circuits.

BACKGROUND OF THE INVENTION

Electrical circuit assemblies are known to comprise at least two electrical circuits and means for interconnecting a primary one of the circuits to the other circuits. Such circuit assemblies are commonly used as circuit test fixtures to functionally test the performance of the primary circuit. In this case, the other circuits are used to provide direct current (DC) power to the circuit under test and to support data acquisition during the functional testing. For example, an electrical circuit assembly is typically used to test the performance of radio frequency (RF) power amplifiers prior to their insertion into two-way radio products, such as base stations, mobile radios, and portable radios. To enable the RF amplifiers to be tested, an external DC power supply is typically coupled to the amplifier via one type of interconnect mechanism, while an RF source and load are connected to the amplifier via another type of interconnect mechanism. It is also known that the DC and RF interconnect mechanisms may be substantially identical.

To prevent damage to the primary circuit during the functional testing, solderess interconnect mechanisms are commonly used to connect the DC and support circuits to the circuit under test. In a typical RF application, DC power is supplied to an RF amplifier circuit through spring-loaded metallic pins, and the RF source and load are connected to the amplifier through spring-loaded RF connectors, such as SMA-style connectors. The RF connectors and DC pins are typically attached to a non-conductive supporting structure, such as a machined plastic plate. Prior to testing the amplifier, the supporting structure is automatically positioned upon the RF amplifier circuit such that the springs in the spring-loaded pins and connectors are compressed to provide electrical connection between the RF amplifier and the DC power and RF support circuits.

Although this approach provides solderless connections between the RF amplifier and the other necessary testing circuitry, the interconnections become unreliable over time due to spring fatigue, such as stress relaxation or cracking, that results from multiple compression and expansion cycles. Thus, to insure reliable interconnections, the springs require periodic maintenance, which results in undesired increases in product test cycle times. Further, in high frequency RF applications, the spring-loaded DC pins negatively impact the functional performance of the RF amplifier circuit since they approximate small antennas and, accordingly, disturb the electromagnetic fields resident in the RF circuit.

Another approach commonly employed in RF circuit assemblies is to use manually actuated fasteners to provide the solderless connection between the circuit under test and the requisite supporting circuitry. Unlike their spring-loaded counterparts, the manually actuated fasteners are located about the periphery of the RF test circuit and, when actuated, provide the necessary contact force to produce electrical connectivity between the RF test circuit and the supporting circuitry. Although the manually actuated fasteners overcome the deficiencies of the spring-loaded interconnect mechanisms, they require and rely on human actuation. Thus, if a manually actuated fastener is inadvertently not engaged and, accordingly, creates an open circuit during the functional testing, damage to the circuit under test may result.

Therefore, a need exists for an electrical circuit assembly that facilitates automatic control of a solderless, electrical connection between two circuits, while maintaining reliability of the electrical connection and being substantially maintenance free.

DESCRIPTION OF A PREFERRED EMBODIMENT

Generally, the present invention provides an electrical circuit assembly that provides a reliable, solderess electrical connection between two electrical circuits. The instant invention is readily adaptable for use with a first electrical circuit that includes at least one electrical contact area disposed on a substrate. An electrically actuatable clamping arrangement is then used to provide an electrical connection between the electrical contact area and a second electrical circuit. By providing the electrical connection in this manner, a more reliable interconnection is provided between the two electrical circuits as compared to the interconnection provided by either spring-loaded or manually actuated, solderless interconnect mechanisms of the prior art.

Figure 1:
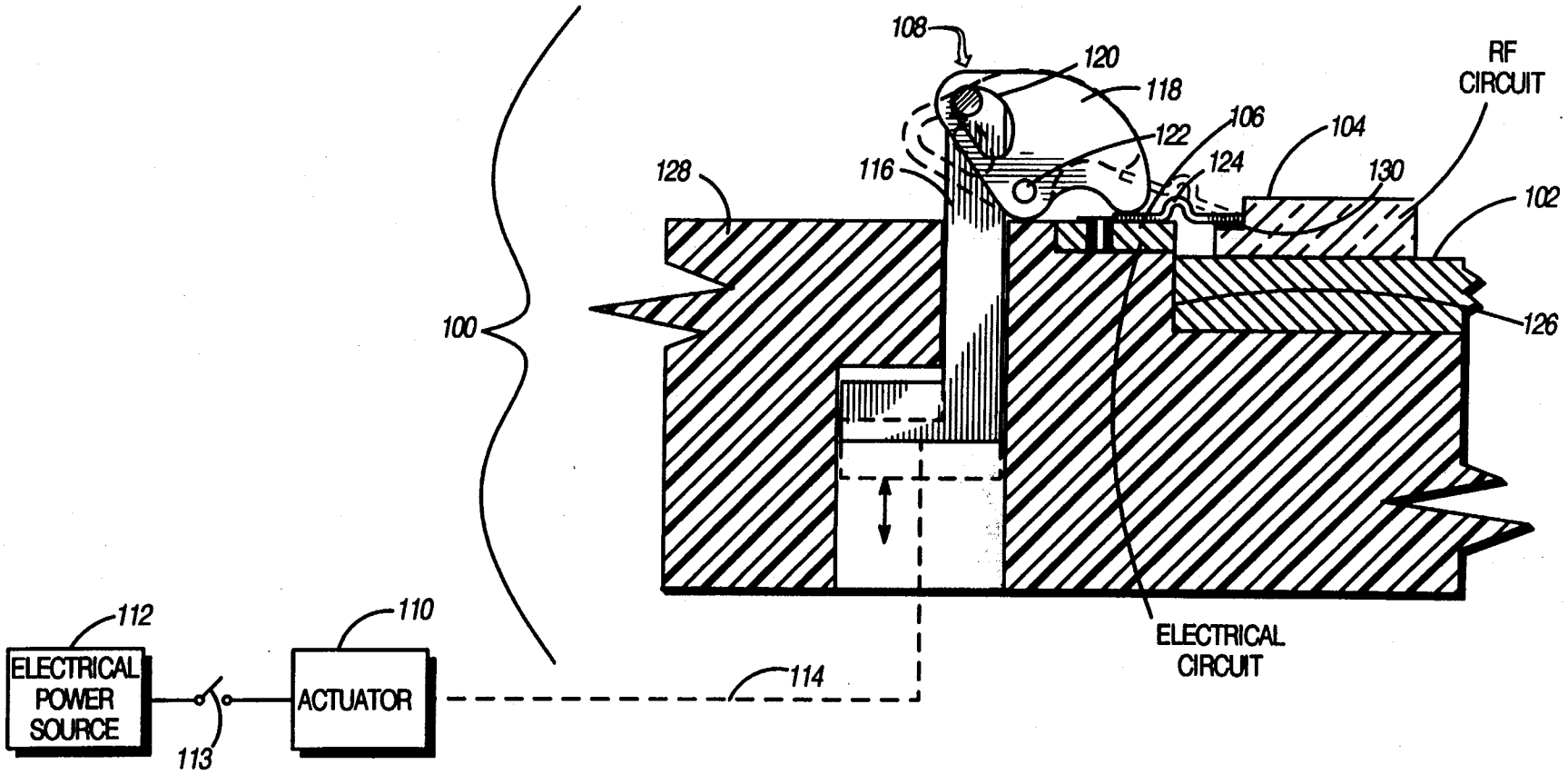
FIG. 1 illustrates a cross-sectional view of an electrical circuit assembly, in accordance with a preferred embodiment of the present invention.

The present invention can be more fully described with reference to FIGS. 1–2. FIG. 1 illustrates a cross-sectional view of an electrical circuit assembly 100, in accordance with a preferred embodiment of the present invention. The electrical circuit assembly 100 comprises a first electrical circuit 104 disposed substantially upon a substrate 102, a second electrical circuit 106, and an electrically actuatable clamping arrangement 108. The electrically actuatable clamping arrangement 108 preferably comprises a piston 116 and a rigid clamping member 118. In a preferred embodiment, the substrate 102 and electrical circuit 106 are retained by a supporting structure 128, such as a machined block of metal or plastic. As depicted, the supporting structure 128 may include recesses and openings to facilitate movement of the piston 116 and operation of the electrically actuatable clamping arrangement 108.

Electrical circuit 104 may comprise analog, digital, or radio frequency (RF) circuitry, and preferably includes an electrical contact area 130—such as a copper pad, or trace—deposited on the substrate 102. The substrate 102 preferably comprises alumina ceramic; however, other dielectric media, such as teflon, cyanate ester, and other printed circuit board materials may also be used. In a preferred embodiment, electrical circuit 104 further includes an electrically conductive contact element 124, such as a so-called "omega strap"—i.e., a thin copper strip formed in the shape of the Greek letter "omega,'-

'—that extends from electrical circuit 104 toward electrical circuit 106.

Similar to electrical circuit 104, electrical circuit 106 may comprise analog, digital, or RF circuitry. In a preferred embodiment, electrical circuit 104 comprises RF and analog circuitry—such as RF transistors, DC transistors, and microstrip circuitry—that provides an RF signal to the electrical contact area 130. Likewise, electrical circuit 106 preferably comprises an RF circuit that is capable of receiving the RF signal produced by electrical circuit 104, such as a microstrip transmission line soldered to a coaxial cable (not shown), and might be positioned external to a perimeter 126 of the substrate 102.

The electrically actuatable clamping arrangement 108 may comprise a variety of materials depending upon where the present invention is utilized. When the present invention is used in an RF circuit test fixture, the piston 116 preferably comprises a metallic material, such as aluminum, copper, or brass. However, when the present invention is used to couple two RF circuits that are located on the same substrate or reside within a perimeter of the same substrate, as later described, a non-metallic material, such as plastic, might be used to minimize the disturbance of existing electromagnetic fields. For RF applications, the rigid clamping member 118 preferably comprises a non-metallic material, such as phenolic, teflon, or plastic. Nevertheless, in direct current (DC) or low frequency digital applications, the rigid clamping member 118 might be metallic in composition.

As depicted in FIG. 1, the rigid clamping member 118 includes an opening 120 that accepts a pin portion of the piston 116 and may further include a hole 122 that supports a pivot pin (not shown). The opening 120 is preferably fabricated to approximate the geometric shape of a nautilus shell (as shown), to permit constant piston pin velocity during operation of the electrically actuatable clamping arrangement 108, and to allow the piston pin to continuously engage the rigid clamping member 118. When used, the pivot pin provides a fixed axis about which the rigid clamping member 118 rotates during actuation and de-actuation of the electrically actuatable clamping arrangement 108.

General operation of the present invention occurs in the following manner. Prior to actuation, it is assumed that the electrically actuatable clamping arrangement 108 is positioned such that the lower portion of the piston 116 (i.e., the portion coupled to control line 114) rests near the bottom of the supporting structure 128. Accordingly, the rigid clamping member 118 is rotated away from the electrically conductive contact element 124, such that a significant air gap exists between the rigid clamping member 118 and the electrically conductive contact element 124. To actuate the electrically actuatable clamping arrangement 108, an electrical power source 112 (e.g., a DC power supply) provides an electrical signal to an actuator 110 after closing a control switch 113. Upon receiving the electrical signal, the actuator 110 forces the piston 116 to rise via the control line 114, thus initiating operation of the electrically actuatable clamping arrangement 108. In a preferred embodiment, the actuator 110 comprises a pneumatic solenoid and a compressed air source, and the control line 114 comprises an appropriate air channel. The electrical power source 112 activates the solenoid, which in turn allows air to flow in the air channel to the piston 116. Thus, the preferred embodiment provides pneumatic control of the electrically actuatable clamping arrangement 108.

However, alternate embodiments of the actuator 110 and the control line 114 may also be envisioned. In one alternate embodiment, the actuator 110 might comprise a hydraulic solenoid and a hydraulic fluid (e.g., oil) source, and the control line 114 might comprise an appropriate hydraulic fluid channel. In still another embodiment, the actuator 110 might comprise a coiled conductor (i.e., a solenoid) that surrounds the piston 116 and uses variations in magnetic field strength to actuate the piston 116.

Upon actuation of the piston 116 by the actuator 110, the piston pin forces the rigid clamping member 118 to rotate about the pivot pin. During the rotation, the rigid clamping member 118 engages the electrically conductive contact element 124, variably forcing it into intimate contact with electrical circuit 106. While the piston 116 remains actuated, the rigid clamping member 118 provides sufficient pressure on the electrically conductive contact element 124 to insure a reliable, solderless electrical connection between electrical circuit 104 and electrical circuit 106. It should be noted that although FIG. 1 displays the rigid clamping member 110 providing pressure in a downward manner, the pressure provided by the rigid clamping member 118 might alternatively be directed upward depending on the particular application requirements imposed on the present invention.

As described hereinabove, the present invention provides a mechanism for reliably interconnecting two electrical circuits 104, 106. By constructing the electrically actuatable clamping arrangement 108 in the disclosed manner, a rigid electrical connection is provided between the two electrical circuits 104, 106 when the electrically actuatable clamping arrangement 108 is engaged. Further, since the disclosed electrically actuatable clamping arrangement 108 does not utilize spring-loading to provide the contact force to the electrically conductive contact element 124, the present invention maintains a substantially constant electrical connection between the two circuits 104, 106 during its operating life. Thus, the present invention eliminates the undesired reduction in contact force provided by springs over time due to spring fatigue by utilizing an electrically actuatable clamping arrangement 108. That is, the present invention does not rely solely upon inherent physical properties of one of its requisite elements to provide and maintain the contact pressure necessary to establish the interconnection.

Figure 2:
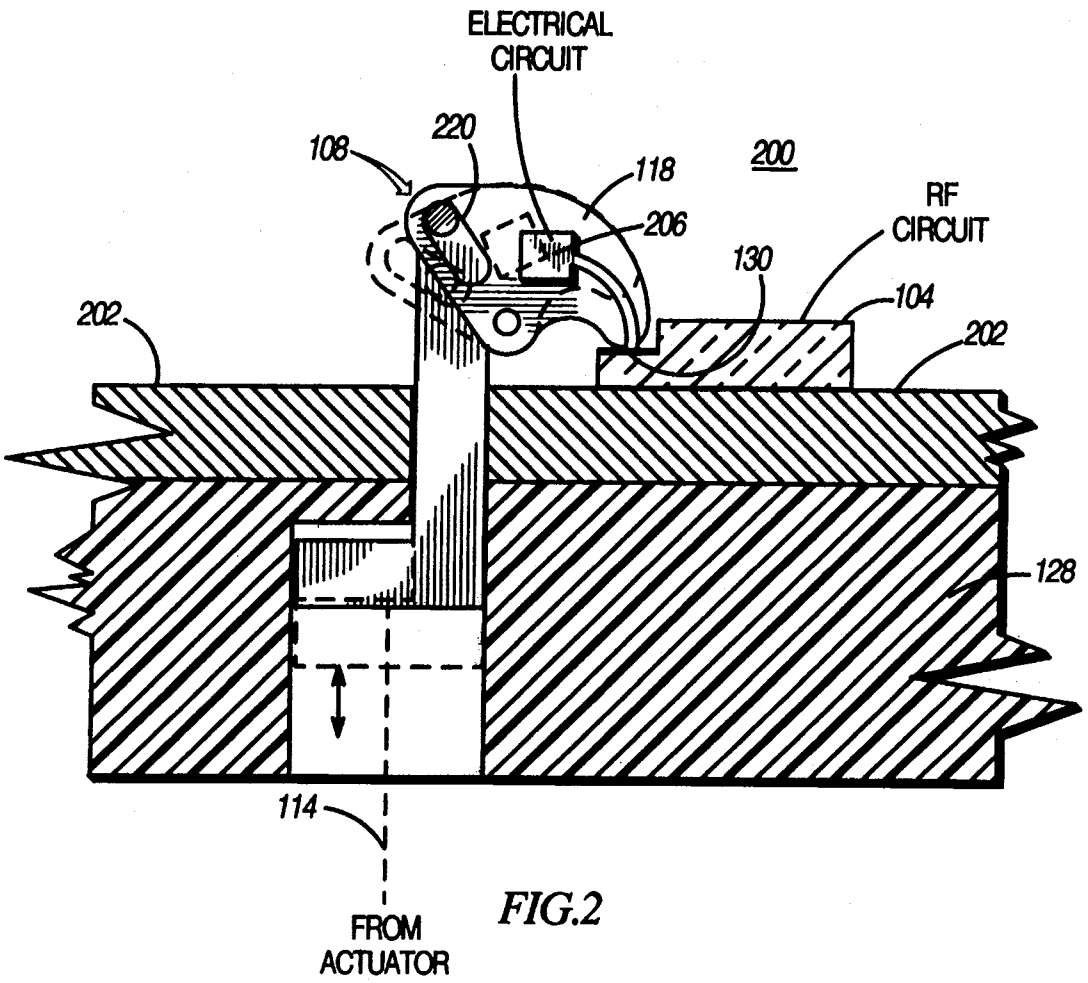
FIG. 2 illustrates a cross-sectional view of an electrical circuit assembly, in accordance with an alternate embodiment of the present invention.

FIG. 2 illustrates a cross-sectional view of an electrical circuit assembly 200, in accordance with an alternate embodiment of the present invention. The electrical circuit assembly 200 comprises electrical circuit 104 disposed substantially upon a substrate 202, a second electrical circuit 206, and the electrically actuatable clamping arrangement 108. In this embodiment, the rigid clamping member 118 provides mechanical support for electrical circuit 206 and the electrically actuatable clamping arrangement 108 protrudes through an opening in the substrate 202 to gain access to electrical circuit 104. Operation of this embodiment of the present invention is similar to the above described operation, except that the rigid clamping member 118 provides a direct, solderless electrical connection between the two electrical circuits 104, 206 (i.e., electrical circuit 104 does not include the electrically conductive contact element 124) and electrical circuit 206 resides substantially within the perimeter of the substrate 202.

It should also be noted that in this embodiment of the electrically actuatable clamping arrangement 108, the rigid clamping member 118 includes a piston pin opening 220 that has a geometric shape of an elongated circle or slot. While this geometric topology is acceptable, it does not permit constant piston pin velocity throughout the rotation of the rigid clamping member 118, and might require increased actuating power from the actuator 110 to overcome added friction between the piston pin and the rigid clamping member 118.

The present invention provides an electrical circuit assembly that establishes a solderless, electrical connection between two electrical circuits. With this invention, a reliable interconnection is provided between the two electrical circuits without the use of springs, which have degrading levels of engagement during their limited operating life. Further, the present invention facilitates automatic control of electrical interconnections, especially in circuit test fixtures that test functional circuit performance, thus eliminating the human intervention necessary to operate and maintain prior art mechanisms, such as manually actuated fasteners.

We claim:

1. An electrical circuit assembly, comprising:

a substrate;

a first electrical circuit disposed on the substrate, wherein the first electrical circuit includes at least one electrical contact area;

a second electrical circuit;

an electrically conductive contact element, operably coupled to the first electrical circuit and extending toward the second electrical circuit; and electrically actuatable clamping means for engaging the electrically conductive contact element so as to provide an electrical connection between the at least one electrical contact area and the second electrical circuit, the electrically actuatable clamping means comprising:

an electrical power source;

a piston, operably coupled to the electrical power source;

actuator means, operably coupled between the electrical power source and the piston, for initiating linear displacement of the piston; and a rigid clamping member, operably coupled to the piston and pivotally disposed about a pivot pin, such that linear displacement of the piston translates to a rotational displacement of the rind clamping member about the pivot pin.

2. The electrical circuit assembly of claim 1, wherein the rigid clamping member comprises at least one pneumatically controlled clamping member.

3. The electrical circuit assembly of claim 1, wherein the rigid clamping member comprises at least one hydraulically controlled clamping member.

4. The electrical circuit assembly of claim 1, wherein the rigid clamping member comprises at least one solenoid actuated clamping member.

5. The electrical circuit assembly of claim 1, wherein the second electrical circuit is disposed at least partially external to a perimeter of the substrate.

6. The electrical circuit assembly of claim 5, wherein the first electrical circuit comprises at least one electrically conductive contact element that extends from the at least one electrical contact area toward the second electrical circuit.

7. The electrical circuit assembly of claim 5, further comprising support means for retaining the substrate and the second electrical circuit.

8. The electrical circuit assembly of claim 1, wherein the first electrical circuit comprises at least one electrically conductive contact element that extends from the at least one electrical contact area toward the second electrical circuit.

9. The electrical circuit assembly of claim 1, wherein the first electrical circuit comprises a radio frequency (RF) circuit that provides an RF signal to the at least one electrical contact area.

10. An electrical circuit assembly, comprising:

a substrate;

a first electrical circuit disposed substantially upon the substrate, wherein the first electrical circuit includes at least one electrical contact area;

an electrically actuatable clamping means comprising:

an electrical power source;

a piston, operably coupled to the electrical power source;

actuator means, operably coupled between the electrical power source and the piston, for initiating linear displacement of the piston; and a rigid clamping member, operably coupled to the piston and pivotally disposed about a pivot pin, such that linear displacement of the piston translates to a rotational displacement of the rigid clamping member about the pivot pin; and a second electrical circuit disposed substantially on the rigid clamping member in such manner as to be electrically coupled to the at least one electrical contact area when the rigid clamping member is rotated about the pivot pin.

11. The electrical circuit assembly of claim 10, wherein the first electrical circuit comprises a radio frequency (RF) circuit that provides an RF signal to the at least one electrical contact area.

12. A method for providing an electrical connection between a first electrical circuit and a second electrical circuit, the method comprising the steps of:

a) providing an electrically actuatable clamping arrangement that comprises;

an electrical power source;

a piston, operably coupled to the electrical power source;

an actuator, operably coupled between the electrical power source and the piston; and a rigid clamping member operably coupled to the piston and pivotally disposed about a pivot pin, such that linear displacement of the piston translates to a rotational displacement of the rigid clamping member about the pivot pin; and b) initiating, using the actuator, linear displacement of the piston such that the rigid clamping member is rotated about the pivot pin to provide an electrical connection between the first and the second electrical circuit.

13. The method of claim 12, wherein the first electrical circuit includes an electrically conductive contact element that extends toward the second electrical circuit, and wherein step (b) further comprises the step of clamping, with the rigid clamping member, the electrically conductive contact element against the second electrical circuit.

* * * * *